United States Patent [19]

Maass et al.

[11] Patent Number: 4,710,055

[45] Date of Patent: Dec. 1, 1987

[54] RIDING-TYPE MULTIPLE TROWEL MACHINE

[75] Inventors: Helmut Maass, West Bend; Joseph H. Klatzka, Hartford, both of Wis.

[73] Assignee: M-B-W Inc., Slinger, Wis.

[21] Appl. No.: 881,255

[22] Filed: Jul. 2, 1986

[51] Int. Cl.[4] ..... E01C 19/22

[52] U.S. Cl. ..... 404/112; 416/148

[58] Field of Search ..... 404/112, 85, 83; 74/571 M, 571; 180/332; 51/177; 416/148, 121 R, 115, 102

[56] References Cited

U.S. PATENT DOCUMENTS

| | | | |
|---|---|---|---|
| 2,389,798 | 11/1945 | Main | 416/115 |
| 2,624,250 | 1/1953 | Bird | 404/112 |
| 2,869,442 | 1/1959 | Mincher | 404/112 |
| 2,887,934 | 5/1959 | Whiteman | 404/112 |
| 3,080,002 | 3/1963 | DuPont | 416/148 X |
| 3,412,657 | 11/1968 | Colizza et al. | 404/112 |
| 3,936,212 | 2/1976 | Holz et al. | 404/112 |
| 4,046,484 | 9/1977 | Holz et al. | 404/112 |
| 4,312,603 | 1/1982 | Whiteman, Jr. | 404/112 |
| 4,358,123 | 11/1982 | Richards | 404/85 X |
| 4,367,880 | 1/1983 | Harding | 404/85 X |

*Primary Examiner*—James A. Leppink

*Assistant Examiner*—Matthew Smith

*Attorney, Agent, or Firm*—Andrus, Sceales, Starke & Sawall

[57] ABSTRACT

A riding-type surface working machine includes a pair of rotors each of which carries a plurality of trowels or surface working members. Each rotor includes a transmission unit and power from the engine is transmitted through each transmission unit to rotate the individual rotors. To provide directional movement for the machine, the upper end of each rotor includes a shaft that is connected to the respective transmission unit. The shaft is mounted for universal tilting movement with respect to the frame of the machine. An eccentric is mounted on each rotor shaft and is rotatable in a fixed sleeve. Each eccentric is connected through a chain drive to a vertical control stick and the control sticks for the respective rotors are mounted concentrically on the machine. Through manual operation of the control sticks the eccentrics can be individually rotated to thereby tilt the rotors to cause directional movement of the machine. To enable the machine to be transported, a group of wheels are connected to the protective guard that surrounds the rotors and can be pivoted between an upper storage position and a lower transporting position.

11 Claims, 9 Drawing Figures

RIDING-TYPE MULTIPLE TROWEL MACHINE

BACKGROUND OF THE INVENTION

In the past walk-behind trowelling machines have been employed which incorporate a rotor that carries a plurality of surface working members or trowels. By manually exerting pressure on the handle, the rotor can be tilted to cause the desired directional movement of the machine over the surface.

More recently, riding type trowelling machines have been utilized which incorporate two or more rotors, each of which carries a plurality of trowels. As described in U.S. Pat. Nos. 3,936,212 and 4,046,484 directional movement of the riding type trowelling machine can be achieved by a mechanism in which each rotor is hinged to the frame and the operator applies selective downward tilting pressure to specific locations on the guard rings that surround each rotor. The pressure is applied by a complicated linkage system actuated by a control stick and foot pedals. Through this system, the rotors can be individually tilted with respect to the frame to cause directional movement of the machine over the surface.

With the directional control system as described in the aforementioned patents, the operator must continually apply pressure through the hand and foot controls to cause directional movement of the machine. The continual application of pressure can be fatiguing to the operator over an extended period of time.

As a further problem, the conventional riding type trowelling machine has no provision for transporting the machine from one location to another at a given site. For example, if it is desired to move the machine to a different location, the machine must be lifted and carried by several workmen, or alternately, a hoist or material handling equipment must be employed to transport the machine.

SUMMARY OF THE INVENTION

The invention is directed to a surface working machine having an improved and simplified directional control mechanism and having a built-in provision for transporting the machine.

In accordance with the invention the machine includes a pair of rotors each of which carries a plurality of trowels or surface working members. The rotors are rotated about their axes by a drive system that connects the engine of the machine to a transmission unit on the respective rotor.

To affect directional movement of the machine, the upper end of each rotor includes a shaft that is mounted for universal or wobble-type movement. The upper end of the shaft carries an eccentric which is journalled within a fixed housing, and the eccentric of each rotor is connected through a chain drive to a control stick or column mounted centrally on the machine. The control sticks for the respective rotors are mounted concentrically of each other and each includes a manual operating handle. By selective rotation of the control sticks, the eccentrics can be rotated to cause tilting movement of the rotors and thereby affect directional movement of the machine over the surface.

The tilt control mechanism of the invention is of simple design and provides infinite tilting of the rotors without the use of complicated mechanical linkages. In addition, the tilt control mechanism is self contained in a location where it will not become damaged or contaminated by foreign materials.

As a further advantage, the eccentric of the tilt control mechanism is self locking so that it is not necessary to continually apply pressure to the operating handle to achieve directional control. This results in a substantial reduction in operator fatigue.

The tilt control system is more precise than systems used in the past because of the infinite adjustment of each eccentric and the rotor shaft.

As a further feature of the invention, a plurality of wheels are rotatably mounted on arms that are pivotably connected to the protective guard frame which surrounds the rotors. The wheels are adapted to be pivoted from a storage position where they are located above the level of the trowels to an operative position where they are located beneath the level of the trowels so that the machine can then be transported on the wheels. When in the operative position, the wheels are locked to the protective guard, and a steering handle can be connected to one of the wheels to achieve steering control of the machine as is being transported.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
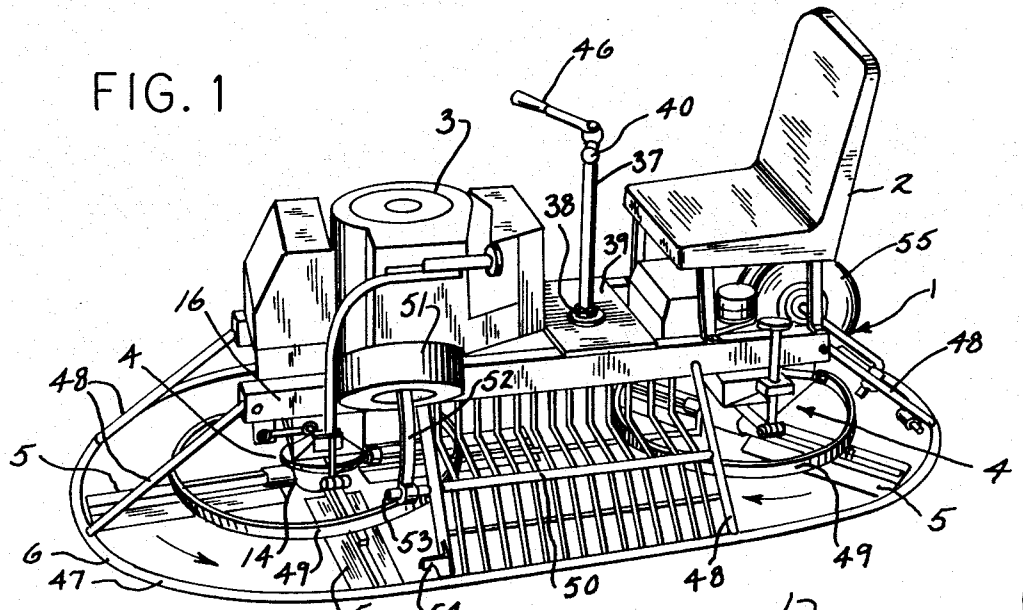
FIG. 1 is a perspective view of the troweling machine of the invention.

The drawings illustrate a riding-type surface working machine having particular use for troweling concrete. The machine includes a frame 1 which supports an operator's seat 2 and an engine 3. A pair of rotors 4 are mounted in spaced fore and aft relation on the frame and each rotor carries a plurality of trowels 5 or surface working members. As shown in FIG. 1, a protective guard 6 is attached to frame 1 and surrounds the rotors 4 and trowels 5.

Figure 3:
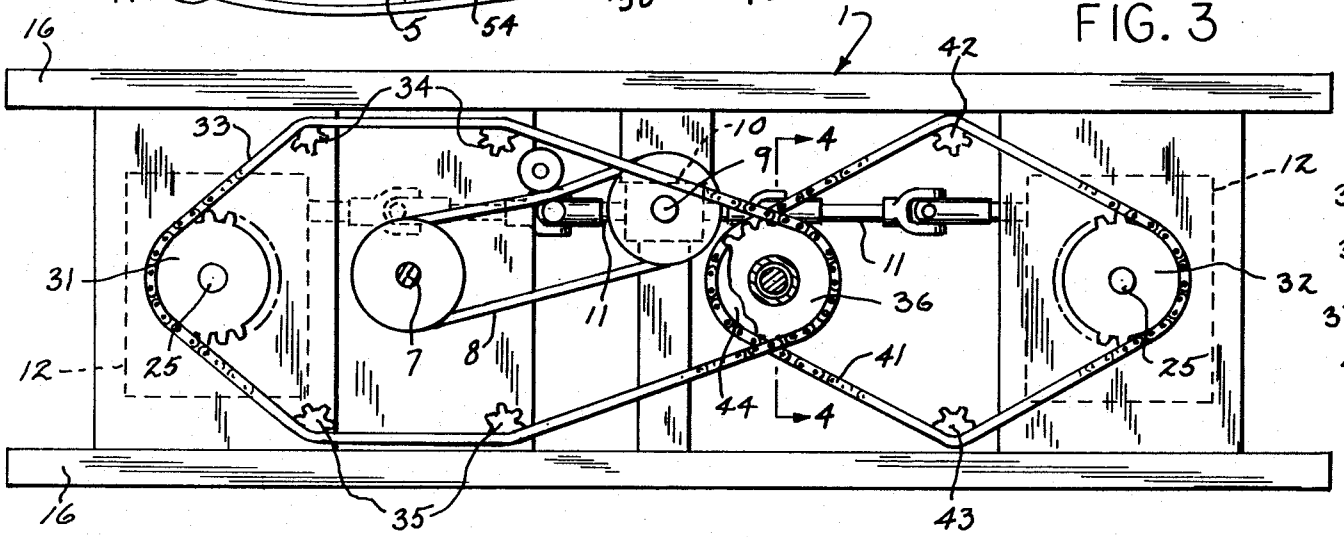
FIG. 3 is a horizontal section showing the chain drive which connect the control sticks to the respective rotors.

To rotate the rotors 4, the output shaft 7 of engine 3 is connected by belt-drive 8 to the input shaft 9 of a gear box 10 that is supported by frame 1. As best shown in FIG. 3, gear box 10 has a pair of diametrically opposite output shafts 11, each of which is connected to a worm gear transmission 12. The vertical output shaft 13 of each transmission unit 12 is connected to a spider 14 and the trowels 5 are mounted on the spider 14.

Trowels 5 are of a conventional construction and the rotational leading edge of each trowel is curved upwardly. The pitch of all trowels can be controlled during rotation through operation of a known pitch control mechanism.

With this drive construction, operation of engine 3 serves to rotate the trowels 5 in opposite directions, as indicated by the arrows in FIG. 1.

Figure 2:
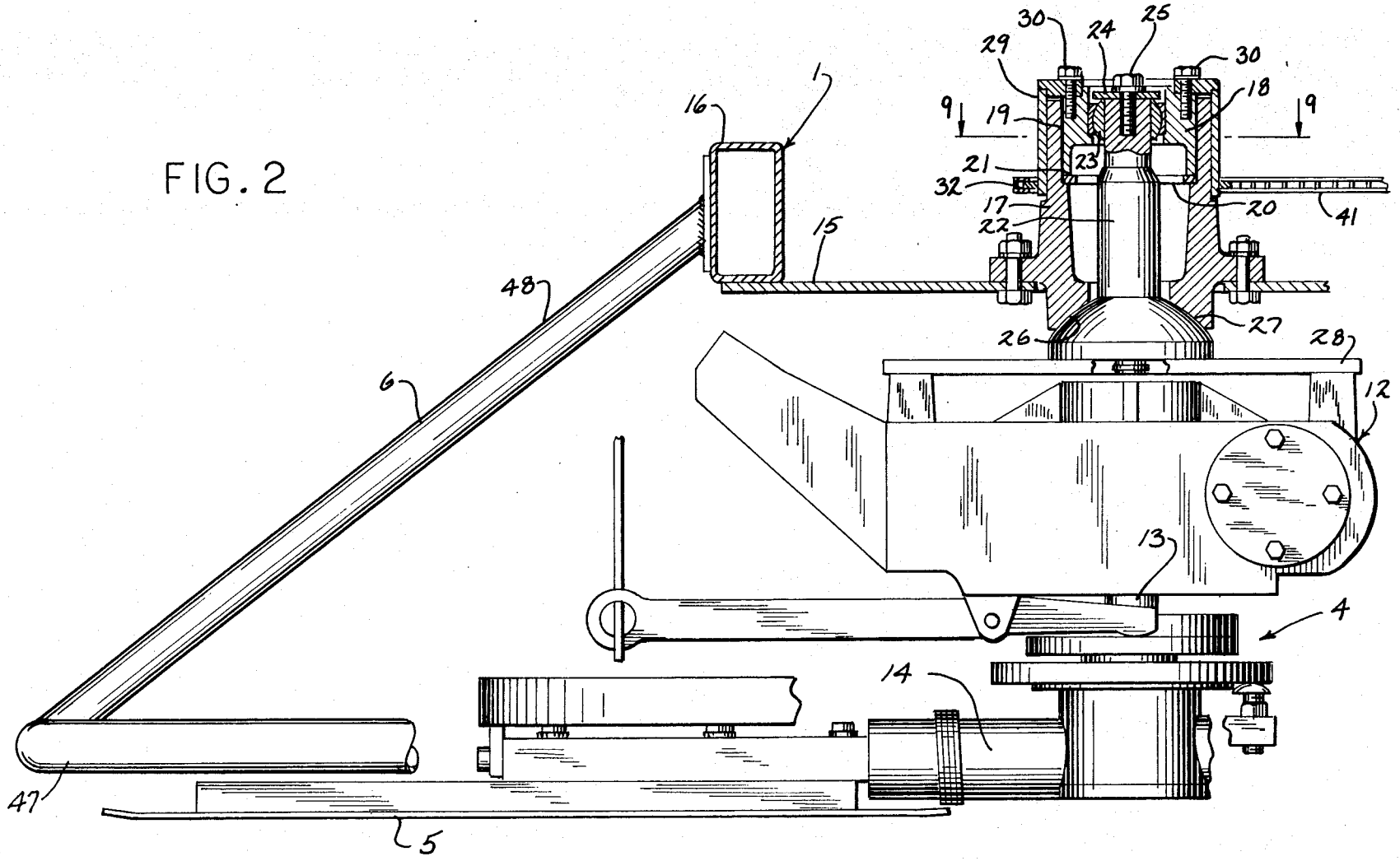
FIG. 2 is a fragmentary side elevation with parts broken away showing the tilt control mechanism.

The invention incorporates an improved directional control mechanism for the machine. In this regard, a plate 15 extends between side beams 16 of frame 1, as shown in FIG. 2, and housing or sleeve 17 is mounted through bolts within an opening in plate 15. An eccentric or cam 18 is mounted for rotation within the upper end of housing 17 and a bearing liner 19 is positioned between the adjacent surfaces of the eccentric 18 and housing 17. As shown in FIG. 2, the lower end of eccentric 18 bears against a thrust washer 20 that is mounted on an internal shoulder 21 in housing 17.

Eccentric 18 is journalled around the upper end of rotor shaft 22 by a radial self-aligning bushing 23. Retaining washer 24 is attached to the upper end of shaft 22 through screw 25.

As shown in FIG. 2, the lower end of shaft 22 defines a generally spherical surface 26 which is mounted for universal movement within socket 27 formed in the lower end of housing 17.

Secured to the lower end of shaft 22 is a plate 28 which is bolted to the upper surface of the transmission unit 12.

With this construction, rotation of eccentric 18 will cause wobble or universal tilting movement of shaft 22 along with tilting movement of the transmission 12 and trowels 5.

To rotate each eccentric 18, a cup-shaped member 29 surrounds the upper end of housing 17 and is connected to eccentric 18 through screws 30. The member 29 of one rotor 4 carries a sprocket 31, while the member 29 associated with the other rotor carries a second sprocket 32 which is located at a different level than sprocket 31.

Sprocket 31 is connected to chain 33 and the chain travels in a generally diamond-shaped pattern over idler sprockets 34 and 35 and is connected to a sprocket 36 mounted on the lower end of vertical control stick or column 37. Column 37 is journalled for rotation in a bearing 38 mounted on floor plate 39 and the upper end of column 37 carries an operating handle 40.

Figure 4:
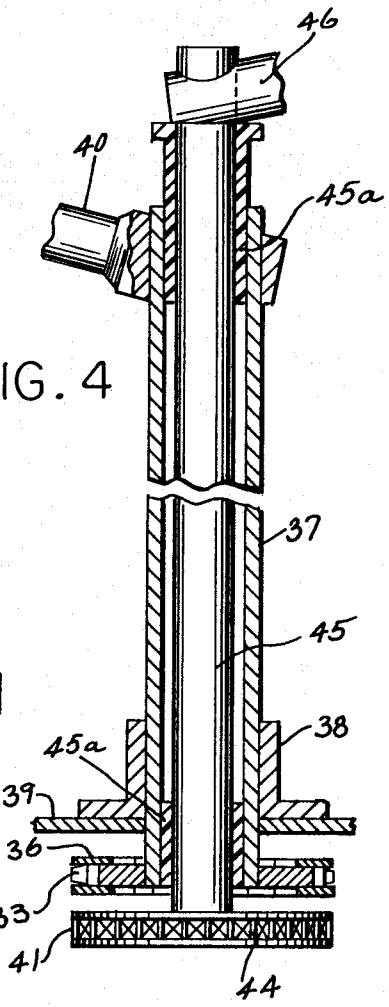
FIG. 4 is a vertical section taken along line 4—4 of FIG. 3 showing the concentrically mounted control sticks.

Similarly, a chain 41 is connected to sprocket 32 and travels around idler sprockets 42 and 43 and is connected to a drive sprocket 44 mounted on the lower end of control column 45. Control column 45 is journalled by bushings 45*a* within the column 37 as shown in FIG. 4. The upper end of column 45 carries a handle 46 which is located at a level above handle 40.

Through operation of handles 40 and 46, columns 37 and 45 can be individually rotated to thereby selectively rotate the eccentrics 18 of the individual rotors 4 and cause tilting movement of the trowels 5 to provide directional control for the machine.

When the two handles 40 and 46 are vertically aligned in a fore and aft direction, the two eccentrics 18 of rotors 4 will be in the same orientation with respect to the longitudinal axis of the machine so that there will be no directional movement of the machine even though the rotors are rotating. By selectively moving one of the eccentrics 18 through operation of the respective handle, the eccentrics will be moved out of orientation to provide universal directional movement for the machine.

Eccentrics 18 are self-locking so that the operator does not have to continually apply pressure through handles 40 and 46 to maintain the eccentrics in a given position. As the operator is not required to continually apply pressure to the handles, operator fatigue is substantially reduced.

As the rotor shafts 22 are universally tiltable, more precise control of direction can be achieved as compared to prior devices, in which tilting of the rotor with respect to the frame could only be accomplished at specific locations on the frame.

As shown in FIG. 1, protective guard 6 includes an outer guard member 47 which is connected to frame 1 through braces 48. In addition, the guard includes a pair of inner rings 49 each of which is mounted concentrically above the trowels 5 of each rotor. Guard 6 also includes a pair of side guard units 50 which also serve as steps for the operator.

Figure 5:
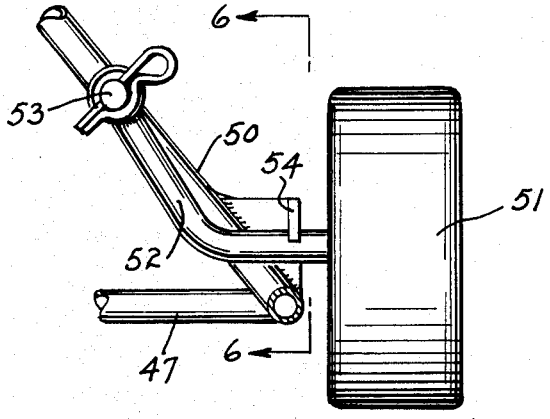
FIG. 5 is fragmentary enlarged end view showing one of the transporting wheels in the transporting position.
Figure 6:
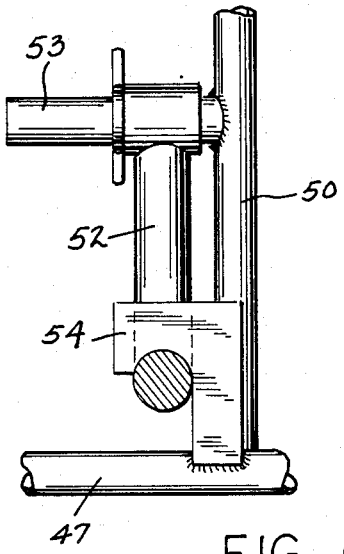
FIG. 6 is a section taken along line 6—6 of FIG. 5.

As a feature of the invention, the machine includes a plurality of wheels that can be lowered from a storage position to a position where the machine can be readily transported between locations at a given working site. In this regard, the machine includes a pair of side wheels 51, each of which is mounted for rotation on the end of a tubular arm 52. Each arm 52 is mounted for pivoting movement about a horizontal extension 53 which extends forwardly from the side guard unit 50. With this construction, each side wheel 51 can be moved to a storage position, where the wheels are located adjacent engine 3, and an operating position where the wheels project downwardly beneath the level of the trowels 5 so that the machine can be transported. Wheels 51 are locked in the lowered or transporting position by engagement of arms 52 with latch members 54 that are secured to side guard units 50 as shown in FIGS. 5 and 6.

Figure 7:
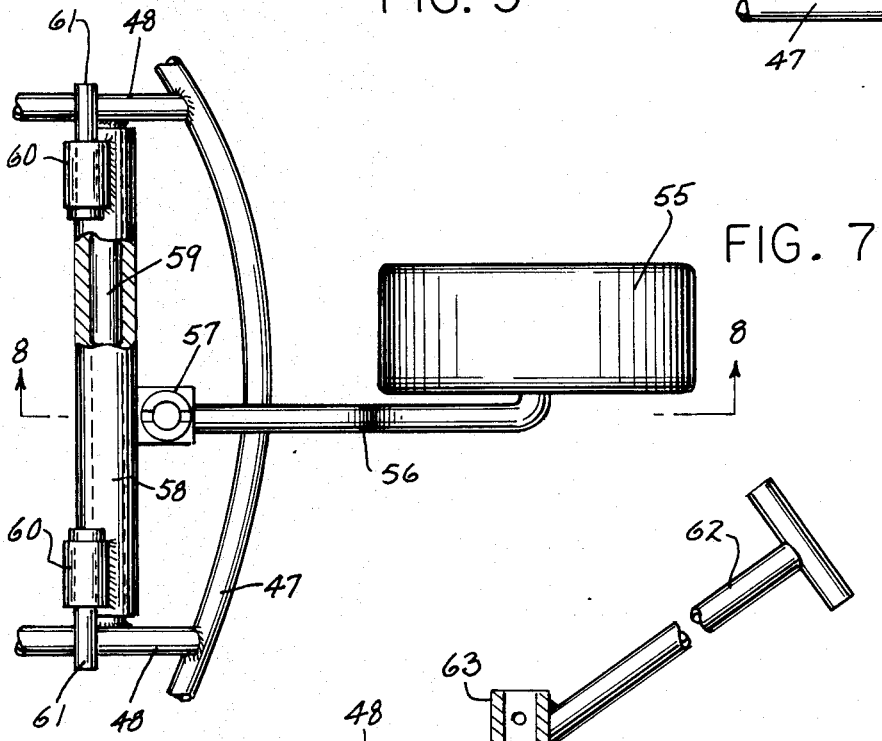
FIG. 7 is a fragmentary plan view with parts broken away the rear wheel.
Figure 8:
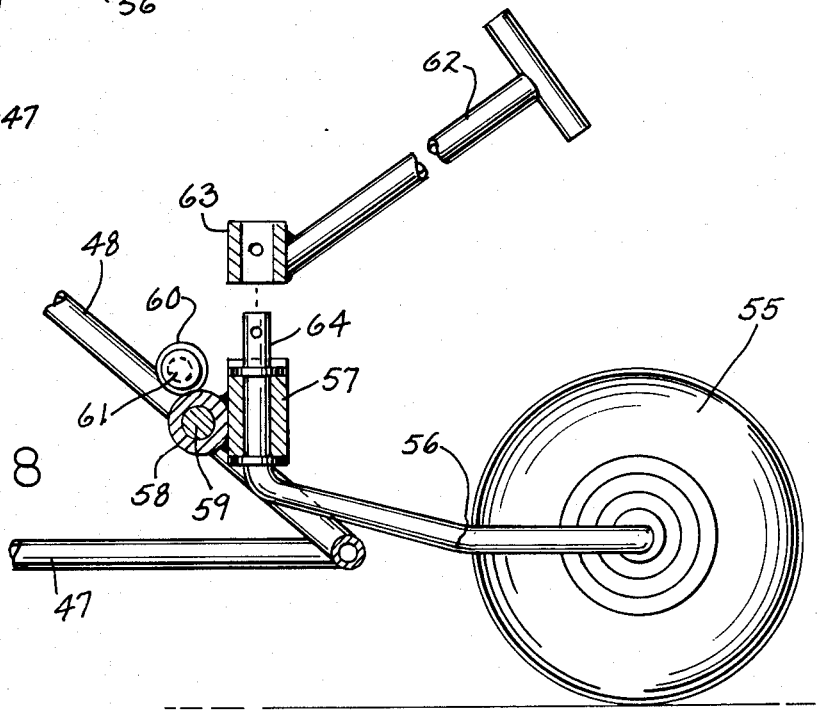
FIG. 8 is a section taken along line 8—8 of FIG. 7.
Figure 9:
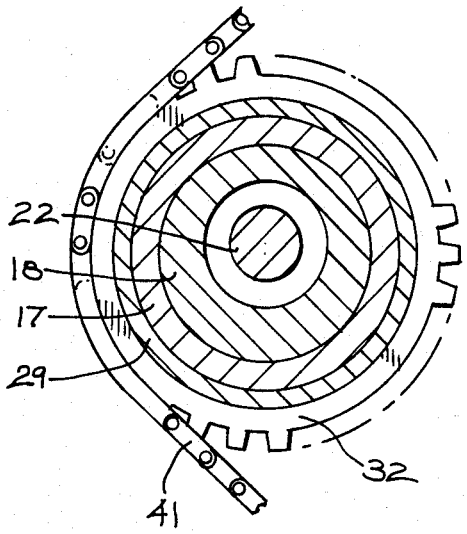
FIG. 9 is a section taken along line 9—9 of FIG. 2.

In addition to side wheels 51, the machine also includes a rear wheel 55 which is journalled on the end of a tubular arm 56 as shown in FIG. 7. The end of arm 56 is secured within an opening in a collar 57 and collar 57 in turn is welded to the outer surface of a horizontal tube 58 which is mounted for rotation about rod 59 that extends between braces 48. With this construction, rear wheel 55 can be pivoted about the axis of rod 59 between an upper storage position and a lower transporting position.

To lock the wheel 55 in the transporting position, sleeves 60 are welded to the outer surface of tube 58 and pins 61 are slideable within sleeves 60 and are adapted to engage the upper surfaces of the respective braces 48 when the wheel 55 is in the transporting position to lock the wheel in this position, as shown in FIG. 7.

As a further feature, the machine of the invention includes a steering handle 62 which can be used to steer the machine as it is being transported on wheels 51 and 55. One end of steering handle 62 carries a sleeve 63 which is adapted to fit over the projecting upper end 64 of arm 56. Sleeve 63 is locked to end 54 by a pin, not shown, that extends through aligned holes in sleeve 63 and 64.

Wheels 51 and 55 provide a simple and convenient mechanism for transporting the machine. As the wheels are permanently connected to the frame of the machine they cannot be lost or misplaced.

Various modes of carrying out the invention are contemplated as being within the scope of the following claims particularly pointing out and distinctly claiming the subject matter which is regarded as the invention.

I claim:

1. A riding-type surface working machine, comprising a frame, at least one rotor means mounted on the frame, surface working means carried by said rotor means and adapted to rotate in contact with a surface to be worked, an eccentric carried by said rotor means and mounted for rotation relative to said frame, mounting means for mounting said rotor means for universal tilting movement with respect to said frame, drive means for rotating said rotor means about its axis to thereby rotate said surface working means, and operating means for rotating said eccentric and thereby tilting said rotor means to cause selective directional movement of said machine.

2. The machine of claim 1 wherein said operating means comprises a manually actuated control member.

3. A riding-type surface working machine, comprising a frame, a pair of rotors mounted on the frame, surface working means carried by each rotor and disposed to be rotated in contact with a surface to be worked, eccentric means operably connected to each rotor, and operating means for individually rotating each eccentric means to thereby individually cause tilting movement of the respective rotor and surface working means, said eccentric means being constructed and arranged such that similar orientation of the eccentric means of each rotor provides a neutral position to prevent directional movement of said machine and rotation of one of said eccentric means relative to the other eccentric means causes selective directional movement of said machine.

4. A riding tvpe surface working machine, comprising a frame, a pair of rotors mounted on the frame, a plurality of trowels carried by said rotor and adapted to rotate in contact with a surface to be trowelled, each rotor including a shaft, an eccentric carried by each shaft and mounted for rotation relative to said frame, means for mounting said shaft for universal tilting movement with respect to said frame, drive means for rotating each rotor about its axis to thereby rotate said trowels, and separate operating means individually connected to each of said eccentrics for individually rotating said eccentrics and thereby tilting the respective rotor to cause selective directional movement of said machine.

5. The machine of claim 4, wherein said frame comprises a sleeve and said eccentric is mounted for rotation within said sleeve, said machine also includes bearing means for journalling said eccentric around said shaft, said bearing means being constructed and arranged to permit tilting movement of said shaft relative to said frame.

6. The machine of claim 5, and including an outer tubular member disposed around said sleeve and connected to said eccentric, and flexible drive means interconnecting each tubular member and the respective operating means.

7. The machine of claim 6, wherein said flexible drive means comprises a drive chain.

8. The machine of claim 4, wherein each operating means comprises a vertical column and a handle connected to the upper end of each column.

9. The machine of claim 8, wherein said columns are disposed concentrically and said handles are vertically spaced.

10. The machine of claim 9, wherein a first of said columns is journalled within a second of said columns and the upper end of said first column projects outwardly of the upper end of said second column.

11. A riding-type concrete troweling machine, comprising a frame, a pair of rotors mounted on the frame, surface working means carried by each rotor, a pair of tubular housings mounted on said frame, cam means mounted for rotation within each housing, each rotor including a generally vertical shaft journalled within the respective cam means, mounting means for mounting each shaft and rotor for universal tilting movement with respect to said frame, drive means for rotating each rotor about its axis to thereby rotate said surface working means, a pair of control members, and connecting means operably connecting each control member with one of said cam means whereby actuation of each control member will rotate the respective cam means to thereby tilt the respective rotor and surface working means and cause directional movement of said machine.

* * * * *